US005853258A

United States Patent [19]

Woodruff

[11] Patent Number: 5,853,258

[45] Date of Patent: Dec. 29, 1998

[54] SEGMENTED EXTENSION WAND FOR FLUID SPRAY APPLICATOR

[75] Inventor: Byron J. Woodruff, Santa Clara, Calif.

[73] Assignee: Paint Trix Inc., Sunnyvale, Calif.

[21] Appl. No.: 854,552

[22] Filed: May 12, 1997

[51] Int. Cl.[6] ..... B43M 11/02

[52] U.S. Cl. ..... 401/219; 401/27; 401/208

[58] Field of Search ..... 401/219, 27, 289, 401/208, 218

[56] References Cited

U.S. PATENT DOCUMENTS

| | | | |
|---|---|---|---|
| 2,030,849 | 4/1936 | Reed et al. | 401/27 |
| 2,949,620 | 8/1960 | Noble | 401/219 |
| 3,015,837 | 1/1962 | Teall | 15/544 |
| 3,915,382 | 10/1975 | Davis | 239/195 |
| 4,140,410 | 2/1979 | Garcia | 401/150 |
| 4,323,196 | 4/1982 | Logue et al. | 239/532 |
| 4,778,298 | 10/1988 | Shin et al. | 401/27 |

FOREIGN PATENT DOCUMENTS

| | | |
|---|---|---|
| 1009-522 | 4/1983 | Russian Federation . |

*Primary Examiner*—David J. Walczak

*Attorney, Agent, or Firm*—Thomas Schneck; John P. McGuire, Jr.

[57] ABSTRACT

A fluid applicator for surfaces combining a spray-gun and dynamically displacable roller-brushes that features an extension wand formed from a plurality of coupled together segments. Each of the segments include a hollow and rigid tubular body completely encasing a flexible high pressure fluid hose. The tubular body includes a coupler connected at each end thereof, with the fluid hose extending between the couplers. Each coupler includes a large bore region having a plurality of threads. Adjacent segments are coupled together by a threaded barrel adapted to threadably engage adjacent large bore regions. Disposed opposite to the large bore regions of each coupler is a small bore region which has a plurality of threads which are adapted to engage the a threaded attachments associated with conventional high pressure fluid hoses. In this fashion, a fluid tight seal is formed between opposed ends of each segment.

18 Claims, 8 Drawing Sheets

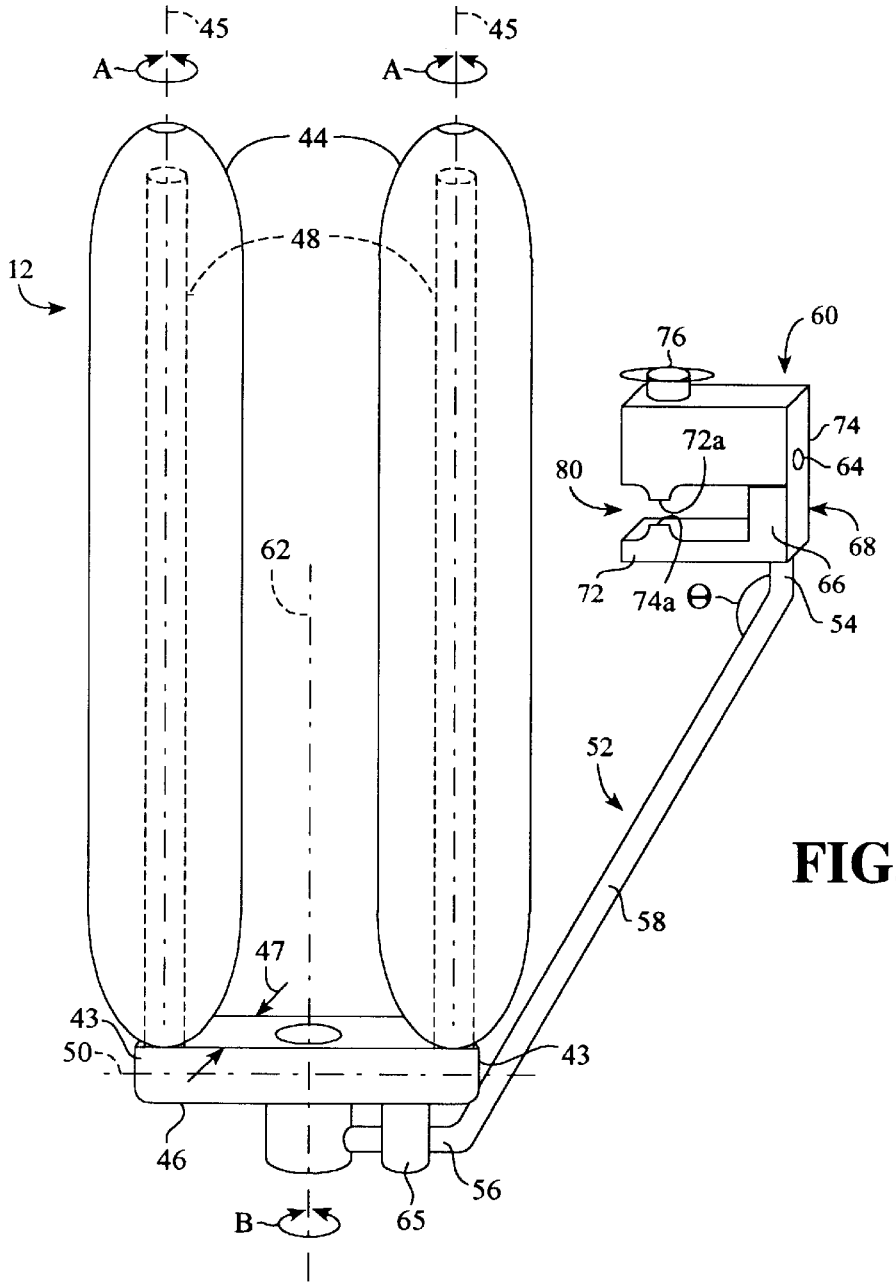
FIG. 3
FIG. 4
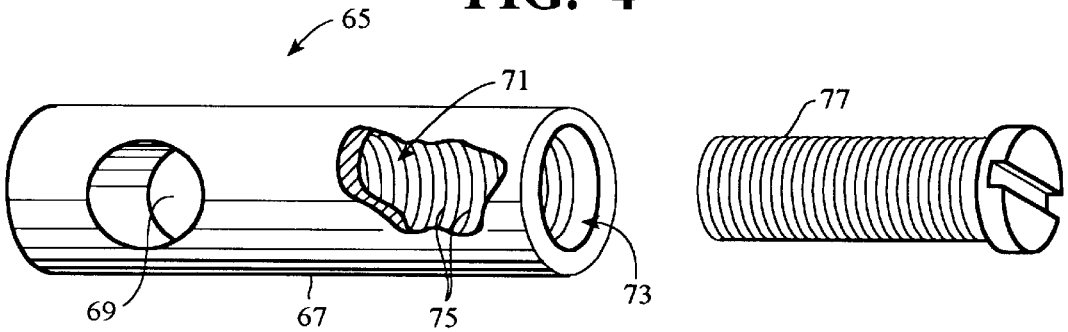

SEGMENTED EXTENSION WAND FOR FLUID SPRAY APPLICATOR

TECHNICAL FIELD

The present invention relates to fluid application devices. Specifically, the present invention relates to extension wands particularly suited for fluid fluid applicators employing roller-brushes.

BACKGROUND ART

Various applicators may be employed to deposit fluid, such as paint, onto a surface, e.g. bristle-brushes, roller-brushes and high and low pressure spray-guns. The choice of applicator is typically dependent upon the texture of the surface to which the paint will be deposited. For example, traditional bristle-brush applicators, of the type having a plurality of bristles extending parallel to an axis of a handle, have been found particularly useful for depositing paint onto surfaces having a rough texture. A problem with the traditional bristle-brush is that the paint, to be deposited on a surface, is kept in a reservoir which is remotely disposed with respect to the surface. Further, the relatively short handle of the paint brushes often necessitates using a ladder or other device to allow a user to deposit paint upon areas that would otherwise be beyond the user's reach. This results in a great amount of time being consumed moving the bristle-brush between the reservoir and the surface.

To reduce the time necessary to deposit paint on a surface, the roller-brush was developed. Although the roller-brush decreases the time necessary to deposit paint, the reservoir of paint is still remotely disposed with respect to the surface and the handle is typically too short to reach many places that require application of a fluid. Extension poles, however, have been provided which couple to the handle of the roller-brushes. The result is often premature fatiguing of a user due to the weight of the fluid on the roller-brush.

The inner feed pressure roller-brush addresses the problem of remotely disposing a paint reservoir from a surface to be covered with paint. Titan Tool, Inc. describes, in a sales brochure, an inner feed pressure roller-brush including an auger rotatably disposed with respect to a hollow frame, with the roller-brush fitting over the auger. However, the inner feed pressure roller-brush suffers the drawbacks of traditional roller-brushes with respect to premature fatiguing of a user.

Spray-guns are well known in the art and overcome many of the aforementioned drawbacks associated with brush applicators. Traditionally, there are two designs for spray-guns. One design employs pressurized air to atomize liquid producing a plurality of atomized liquid particles exiting a nozzle, with the nozzle positioned proximate to a surface on which the liquid is to be deposited. The other design of spray-guns forms a high-pressure fluid stream without air-flow assistance. In this manner, a high pressure stream reaches the nozzle, with the nozzle designed to disperse the stream, forming, on the surface, a fluid envelope of desired geometry. This provides an improved transfer efficiency, typically 65%, as compared with the air-flow assisted spray-guns, which is typically 40%. In both of the aforementioned designs, the nozzle may be remotely disposed with respect to the spray gun by coupling an extension wand therebetween. In addition, the spray gun may be remotely disposed with respect to a reservoir of fluid to be applied to a surface.

Drawbacks associated with the spray-guns is that the wand must be manufactured to prevent puncturing of the same, because high pressure fluid egressing therefrom poses a serious risk of bodily harm to a user and, therefore, substantially raise the risk of liability under a products liability theory to a manufacturer. As a result, many prior art extension wands are formed from a relatively heavy material, such a galvanized steel.

Titan Tool, Inc. describes, in a sales brochure, a combination roller-brush and spray-gun in which a single roller, having a longitudinal axis, is disposed spaced-apart from a spray nozzle. An extension pole is disposed between the nozzle and the spray gun, allowing the nozzle to produce a liquid stream extending tangentially upon the circumference of the roller, along the entire longitudinal axis. To deposit liquid upon a surface, the combination is moved so that the spray-gun deposits the liquid onto the surface with the roller-brush following the spray-gun to uniformly spread the liquid across the surface. A drawback with the Titan roller-brush and spray-gun combination, in addition to its excessive weight, is that the length of the extension wand is fixed, thereby precluding adjustment of the same to allow a user to reach areas of differing heights.

U.S. Pat. No. 3,915,382 to Davis discloses an extension spray gun having a telescopically extendable pole with a spray nozzle secured to one end thereof. A spray gun is attached to the opposing end, and a flexible hose is connected between the nozzle and the spray gun. A portion of the flexible hose is described as extending through the pole and slidably engaged therewith. One end of the flexible hose is fixedly attached to a control valve, and an opposing end is fixedly attached to the spray nozzle. A drawback with Davis is that portions of the fluid hose are exposed which exposes the same to puncturing by sharp objects, posing a great potential of harm to users.

What is needed is a relatively light-weight extension wand, the length of which is easily adjusted, that reduces the risk of injury to a user by high pressure fluid exiting therefrom.

SUMMARY OF THE INVENTION

An extension wand is formed from a plurality of coupled together segments with each segment featuring a hollow and rigid tubular body completely encasing a flexible high pressure fluid hose capable withstanding 4,000 psi. The tubular body includes a coupler connected at each end thereof, with the fluid hose extending between the couplers. Each coupler includes a large bore region having a plurality of threads. Adjacent segments are coupled together, with the fluid hoses associated therewith being in fluid communication, by a threaded barrel adapted to threadably engage adjacent large bore regions. Disposed opposite to the large bore regions of each coupler is a small bore region which has a plurality of threads that are adapted to engage threaded attachments associated with conventional high pressure fluid hoses. In combination with a large diameter tubular body, a fluid-tight seal may be formed between opposed ends of each segment with forces exerted by hand and without necessitating the use of wrenches or other tools. In an alternative embodiment each segment includes a large bore region disposed at one end and a coupler having a threaded cylindrical body extending from an end of the tubular body, opposite to the large bore region. The threads of the cylindrical are adapted to engage the large bore region of an adjacent segment of the wand. By completely encasing the flexible fluid hose within the rigid tubular body, the light-weight extension wand is provided which has a reduced probability of rupturing and, therefore, causing injury.

BRIEF DESCRIPTION OF THE DRAWINGS

FIG. 3 is a perspective view of the apparatus shown in FIG. 2, without the spray-gun, for purposes of clarity.

FIG. 4 is a perspective view of a travel limiter shown is FIG. 2.

BEST MODE FOR CARRYING OUT THE INVENTION

Figure 1:
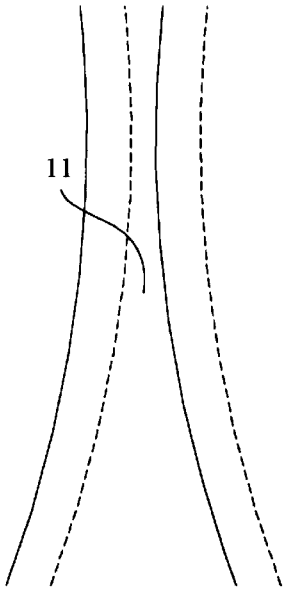
FIG. 1 (Prior Art)
FIG. 1 is a plan view showing stripe patterns of paint deposited upon a surface using a device of the prior art.
Figure 2:
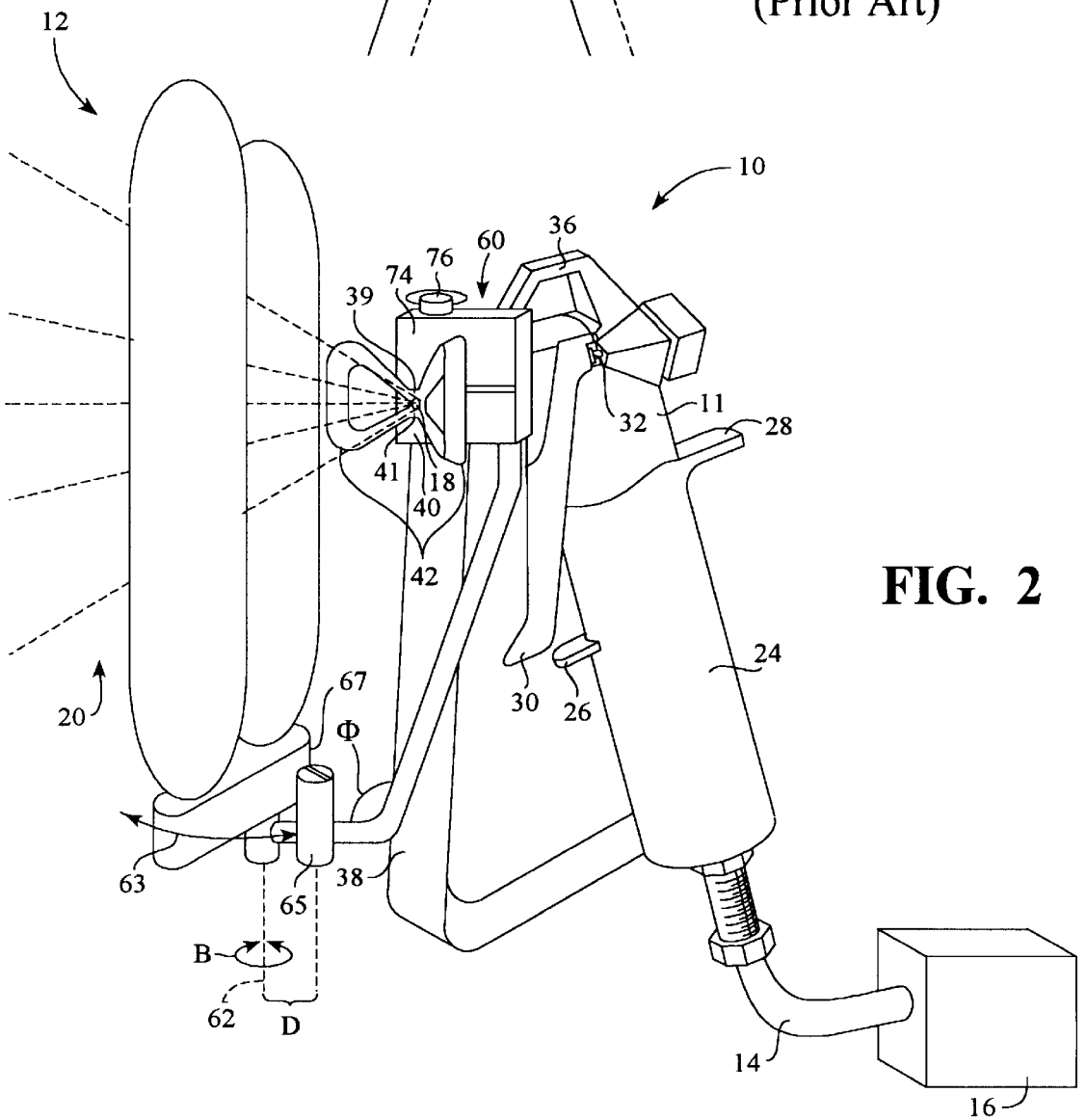
FIG. 2 is a perspective view of a first embodiment of the present invention.

With reference to FIG. 2, the apparatus of the present invention features a hand-held fluid spray-gun 10 in combination with a roller-brush applicator 12 disposed in front of the manifold body 11. Attached to the body 11 from below is an inlet conduit 14 which is in fluid communication with a pressurized source of fluid 16. A nozzle 18 is attached to an opposite end of the body 11, proximate to an outlet, not shown. The nozzle 18 allows a spray of fluid 20 exiting from the outlet to travel toward the roller-brush applicator 12. The body 11 has a grip 24 to facilitate holding the gun 10 by a hand of an operator (not shown) with the grip having a front projection 26 and a rear projection 28 which provide support for the hand holding the gun 10. Disposed above the front projection 26 is a trigger 30 in a position for operation by an index finger of an operator while other fingers of the operator hold the grip 24 below the front projection 26.

The trigger 30 is resiliently disposed to be held away from the grip 24. When moved inwardly toward the grip 24, the trigger 30 actuates a push rod 32, which in turn opens a valve, not shown. The valve controls whether the pressurized fluid can flow through the gun 10 and selectively places the inlet conduit 14 and the outlet in fluid communication. With the trigger 30 moved inwardly, the valve is opened, and the spray of fluid 20 shoots from the nozzle 18. To protect the spray-gun 10 from damage, a top guard 36 projects from a top end. A metal wire 38, or like material, extends between the nozzle 18 and the grip 24, projecting forward thereof to surround the trigger 30 and provide protection for a hand holding the gun 10. A nozzle guard is positioned proximate to the nozzle 18 and includes a body 40 and a pair of projections 42. Each projection 42 is a hollow trapezoid. The projections 42 extend from the body and are symmetrically disposed on, and angled away from, opposite sides of the nozzle 18, with the portion of the projections 42 proximate to the nozzle 18 forming upper 39 and lower 41 notches. The nozzle guard serves to protect a user from the fluid spray 20, while allowing the fluid spray 20 to pass unobstructed.

Referring also to FIG. 3, the roller-brush applicator 12 includes two roller-brush members 44, disposed on opposite ends of a cross-member 46. Any type of roller-brush may be employed. A shaft 48 is disposed at each end 43 of the cross-member 46, shown as dashed lines, with a roller-brush member 44 rotatably disposed thereon. Each shaft 48 extends along the same direction, perpendicular to the longitudinal axis 50 of the cross-member 46. The roller-brush members 44 may rotate in the direction shown by arrows A.

Referring to both FIGS. 2 and 3, a frame 52 comprises a single rod and includes first 54, second 56 and third 58 portions which extend parallel to a common plane. A clamp 60 is attached to the first portion 54 and is discussed more fully below. The first portion 54 extends from the clamp 60, terminating in the third portion 58 and forming an oblique angle $\Theta$ therewith. The third portion 58 extends from the first portion 54, terminating in the second portion 56, forming an oblique angle $\phi$ therewith, with the absolute value of the difference between angles $\phi$ and $\Theta$ approximating 90°. The cross-member 46 is pivotally mounted to the end of the second portion 56, opposite to angle $\phi$, to traverse about a pivot axis 62 along an arcuate path 63. The pivot axis 62 extends parallel to shafts 48, with the shafts 48 and the pivot axis 62 typically lying in a common plane. In this manner, it can be said that the longitudinal axis 45 of the roller-brush members 44 extend parallel to the pivot axis 62. It is preferred that the roller-brush members 44 be symmetrically disposed on opposite sides of the pivot axis 62, with the pivot axis allowing the cross-member 46 to rotate in the directions indicated by arrow B.

The width 47 of the cross-member 46 is measured parallel to the longitudinal axis 50 thereof. To limit the rotational movement of the cross-member 46, a travel limiter, in the way of a detent 65, is mounted to the frame 52 so as to extend across the arcuate path 63, with the width 47 of the cross-member 46 being sufficiently wide to contact the detent 65 when rotated to an extreme angle about pivot axis 62. In this fashion, the spray 20 is prevented from impinging upon the roller-brushes 44. Typically, the detent 65 is spaced-apart from the pivot axis 62, a distance D, and is slidably engaged with the second portion 56 of the frame 52. The amount of rotational movement that the cross-member 46 may undergo is directly proportional to the distance D. By having the detent 65 slidably engaged with the frame 52, the distance D and, therefore, the maximum rotational movement of the cross-member 46, may be varied. To fix the relative position of the detent 65 with the second portion 56, a locking mechanism is provided.

As shown in FIG. 4, the detent 65 includes an elongated body 67 that includes a throughway 69 disposed proximate to one end. The throughway 69 is of sufficient size to allow the second portion 56 to pass therethrough, shown more clearly in FIG. 2. Referring to FIGS. 2, 3 and 4, the elongated body 67 has a chamber 71, one end of which extends from the throughway 69, terminating in an opening 73. The aforementioned locking mechanism consists of a plurality of threads 75 formed on the interior surface of the chamber 71 and a screw 77 adapted to engage the threads 75. Upon reaching a final seating position, one end of the screw 77 enters the throughway 69 wedging against the second portion 56. In this fashion, the distance D may be selectively fixed to establish a preset maximum rotational movement of the cross-member 46 along the arcuate path 63, with both the cross-member 46 and the detent 65 functioning as a stop.

As shown in FIG. 3, one embodiment of the clamp 60 includes a body 64 having first 66 and second 68 opposed major surfaces, with a recess 70 disposed therein, forming a fixed jaw 72. A moveable jaw 74 is disposed opposite to the fixed jaw 72 and includes a lever 76 to secure the position of the moveable jaw 74 with respect to the fixed jaw 72. The fixed jaw includes a tooth 72*a* positioned proximate to the first surface, extending toward the movable jaw 74. Movable jaw 74 includes a tooth 74*a* extending therefrom toward tooth 72*a* and in opposing relation therewith. The clamp 60 is positioned on the first portion 54 of the frame 52 so that the normal to the first major surface extends perpendicular toward the pivot axis 62. The recess 70 receives the body 40 of the nozzle guard, and the lever 76 is adjusted so that the body 40 is wedged between the fixed 72 and moveable 74 jaws, shown more clearly in FIG. 2. Referring to both FIGS. 2 and 3, teeth 72*a* and 74*a* are received with the upper 39 and lower 41 notches, respectively. In this manner, the teeth 72*a* and 74*a* form an interlocking fit with notches 39 and 41 to securely affix applicator 12 to the spray-gun 10. In this position, the nozzle 18 is aligned to face the pivot axis 62.

Figure 5:
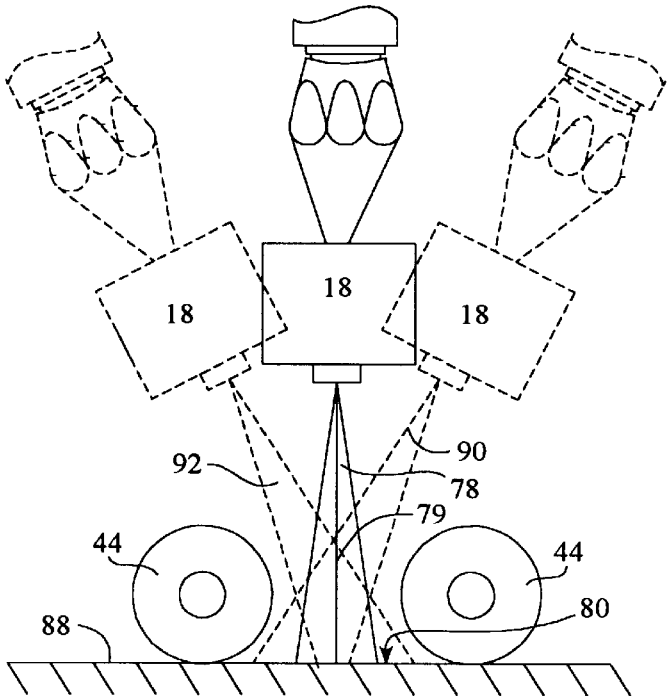
FIG. 5 is a top view of the apparatus shown in FIG. 2, demonstrating the path of a fluid stream compared to a spatial displacement of the roller-brushes with respect to a nozzle.
Figure 6:
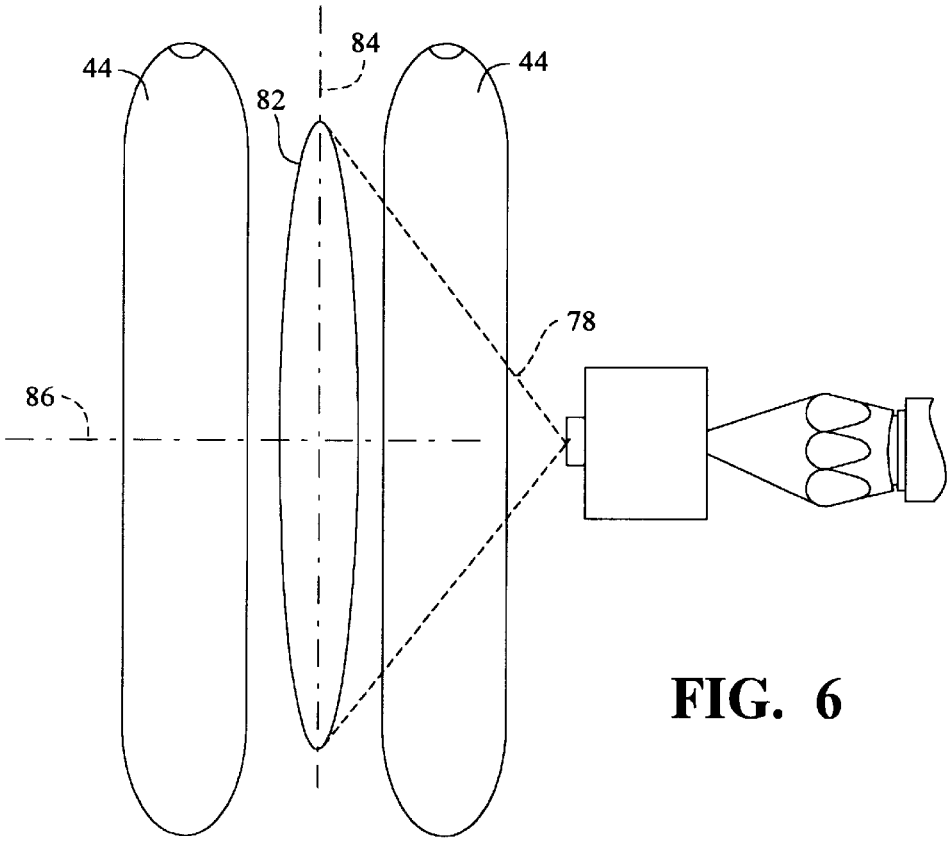
FIG. 6 is plan view showing a spray envelope produced by the nozzle of the apparatus shown in FIG. 4, in accord with the present invention.

Referring also to FIGS. 5 and 6, fluid 20 exiting the nozzle 18 creates a fluid stream 78 having a predetermined geometry that impinges upon a target plane 80, which is generally defined between roller-brush members 44. The fluid stream 78 traverses a flow path 79 defined by the nozzle 18 and fans-out in two directions, forming a fluid envelope 82 upon reaching the target plane 80. The shape and size of the fluid envelope 82 is dependent upon the nozzle 18 employed and the distance between the target plane 80 and the nozzle 18. Although any shape envelope may be formed, the preferred shape of the fluid envelope 82 is that of an ellipsis with the major axis 84 typically extending coextensive with the length of the roller-brushes 44. The minor axis 86 is typically centered along the length of the roller-brushes 44.

In operation, the invention may be used to apply any liquid, e.g., paint, adhesives and the like, to any surface and will be discussed with respect to depositing paint on a wall. The roller-brush members 44 are firmly pressed against the wall 88 that is to receive a coat of paint. The target plane 80 is typically a portion of the wall 88 located between roller-brush members 44. As the spray-gun 10 moves back and forth over the wall, the nozzle 18 distributes the paint in the shape of the flow envelope 82. The roller-brush members 44 spread the paint deposited in the flow envelope 82, over the wall, into a uniform coat. It is apparent that only one roller-brush member 44 spreads the flow envelope 82 at any given time, i.e., the roller-brush member 44 following the nozzle 18 in the direction the spray-gun 10 moves. As the spray-gun 10 moves back-and-forth on the wall 88, the cross-member 46 is allowed to rotate about pivot axis 62. The longitudinal axis 45, of the roller-brush members 44, is displaced with respect to the nozzle 18, and the fluid stream 78, allowing one roller-brush member 44 to move closer thereto, and one further therefrom, while the distance between the target plane 80 and the nozzle 18 remains fixed. This allows the distance between the nozzle 18 and the target plane 80 to be independent of the rotational position of cross-member 46 about axis 62. In this manner, one of the roller-brush members 44 may be positioned so that the fluid stream passes tangentially thereto, shown as fluid streams 90 and 92, which traps the paint thereunder, acting as a shield to prevent over-spray from depositing on the environs about the wall 88. This is particularly useful in that a wall to be painted often terminates adjacent to an object which may be advantageous to shield against paint spray, e.g. a baseboard or a ceiling.

Figures 7, 8:
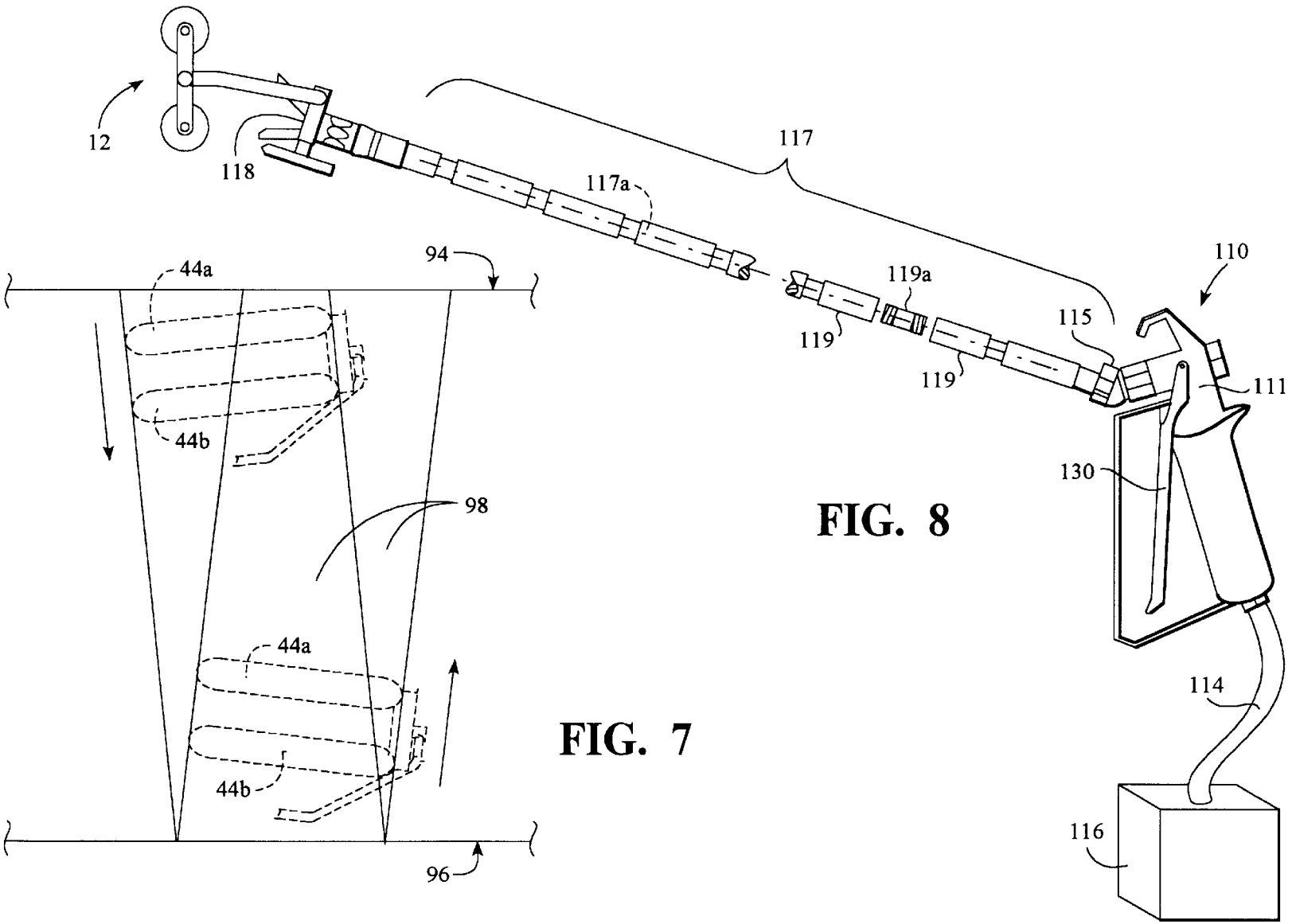
FIG. 7 is a plan view showing stripe patterns of paint deposited upon a surface using an apparatus in accord with the present invention.
FIG. 8 is a side view of an alternate embodiment of the apparatus of the present invention.

For example, as shown in FIG. 7, the wall terminates between a ceiling 94 and floor 96. The preferred method of covering the wall with paint is to apply paint by moving the spray-gun in one motion, e.g., from ceiling 94 to floor 96. With the nozzle 18 positioned proximate to the ceiling 94, the fluid stream 78 passes tangentially to the top roller-brush member 44*a*, with a portion of the spray landing on the wall lying beneath member 44*a*. This prevents paint from impinging upon ceiling 94. In a similar instance, the bottom roller-brush member 44*b* prevents paint from depositing on the floor 96. A further advantage with having two roller-brush members 44 is that wall 88 may be covered in one continuous motion, shown as strips 98. As can be seen in FIG. 7, there is slight overlap among the strips to ensure the wall is completely covered. By maintaining a fixed distance between the nozzle 18 and the target area 82, the width of each strip 98 is made uniform, allowing for a more even distribution of the paint. To further facilitate an even distribution of paint, the frame is formed from a resilient material, such as aluminum or a polymer compound, so that the nozzle 18 is not subjected to the vibration and pounding of moving the roller-brush members 44 across the wall 88. With the nozzle 18 separate from the pivoting applicator 12, flexible hoses are obviated, thereby reducing the effort necessary to use the spray-gun 10.

Referring to FIG. 8, another embodiment of the spray-gun 110 is shown, with an inlet conduit 114 attached to one end of the manifold body 111. Conduit 114 is in fluid communication with a pressurized source of fluid 116. Disposed at the opposite end of the body 111 is an outlet 115 which is selectively placed in flow communication with the inlet conduit 114 by the trigger 130 and valve (not shown) assembly as discussed above with respect to FIG. 2. Disposed between the outlet 115 and a nozzle 118 is an elongated wand 117. The wand 117 allows the nozzle 118 to be remotely disposed with respect to manifold body 111 of the spray-gun 110. The nozzle 118 and the brush applicator 12 are structured and attached as discussed above with respect to FIGS. 2 through 6. The primary difference in this embodiment is that the wand 117 facilitates painting areas that would otherwise be beyond the reach of an unaided user. This enables a user to cover larger areas with less physical exertion.

Figure 9:
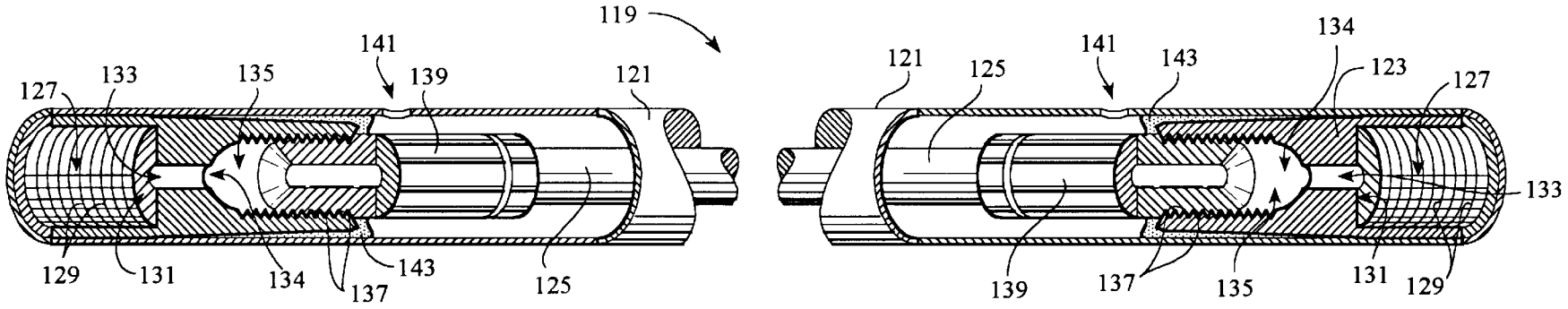
FIG. 9 is a perspective cross-sectional view of an extension wand shown in FIG. 8.

Although any type of wand may be employed, preferably the wand 117 consists of a plurality of coupled together segments 119, one of which is shown in FIG. 9. The segments 119 may be of any length, but preferably are approximately two feet long. The segment 119 includes a hollow, but rigid, tubular body 121 made from any suitable material, e.g., aluminum, nylon, carbon fiber, etc. A coupler 123 is connected at each end of the tubular body 121. Extending between each coupler 123 is a flexible fluid passage 125 which typically comprises of a high pressure fluid hose capable withstanding 4,000 psi. Each coupler 123 includes a large bore region 127 having a diameter of ⅞" and includes a plurality of threads 129. The large bore region 127 extends from one end of the tubular body 121 and terminates in a planar surface 131 having a centrally located throughway 133. The throughway 133 extends from the planar surface 131 terminating in a frusto-conical surface 134 that flares outwardly away from the large bore region 127, terminating in a small bore region 135. The small bore region 135 has a diameter measuring ½ inch and includes a plurality of threads 137. The flexible fluid passage 125 is a conventional type having a threaded attachment 139. The threads 137 of the small bore region 135 are adapted to engage the threaded attachment 139 and form a fluid-tight seal therewith.

To prevent the flexible fluid passage 125 from decoupling from small bore region 135, an aperture 141 is formed into the tubular body 121. A suitable adhesive 143, such as epoxy, is inserted through the aperture 141. The outside surface of the coupler 123 is tapered proximate to the small bore region 135 so that a void is present between the coupler 123 and the tubular body 121. In this fashion, the adhesive 143 fills the void and secures the coupler 123, as well as the flexible fluid passage 125, to the tubular body 121. Two segments 119 are coupled together using a suitable barrel 119*a* having opposed threaded regions adapted to engage the large bore region 127, shown more clearly in FIG. 8.

Figure 10:
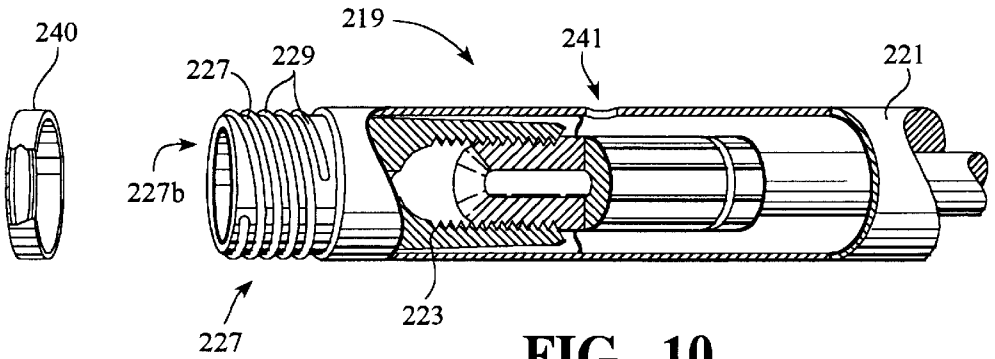
FIG. 10 is a partial perspective cross-sectional view of the extension wand shown in FIG. 9, in accord with an alternate embodiment.

Referring to FIGS. 9 and 10, an alternative embodiment for each segment 219 includes a coupler 123 attached at one end of the tubular body 221, with the opposing end having coupler 223. Coupler 223 is identical to coupler 123 in every respect except that the large bore region 227 of coupler 223 includes a cylindrical body 227*a* that extends from the tubular body 221, ending in a termini 227*b*. The cylindrical body 227 includes a plurality of threads 229 which are adapted to engage the threads 129 of the large bore region 127. In a final seating position, the termini 227*b* seats against the planar surface 131. To maintain a fluid-tight seal therebetween, a compressible washer 240 is disposed against the planar surface 131.

Figure 11:
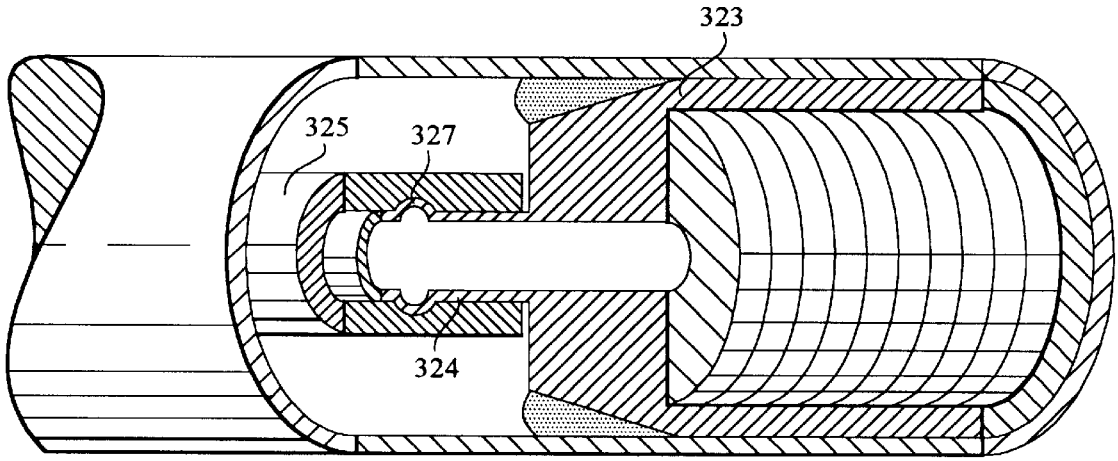
FIG. 11 is a partial perspective cross-sectional view of the extension wand shown in FIG. 9, in accord with an alternate embodiment.

Referring to FIGS. 8 and 11, to reduce the weight of the wand 117 further, each coupler 323 may be formed with a cylindrical protrusion 324 that is adapted to slidably engage the flexible fluid passage 325 and form a fluid-tight seal therewith. In this fashion, the threaded attachments, discussed above with respect to FIG. 9 and which is typically formed from a metal, may be abrogated. The cylindrical protrusion may include a surface feature 327 to securely affix the coupler 323 to the flexible fluid passage 325.

Figure 12:
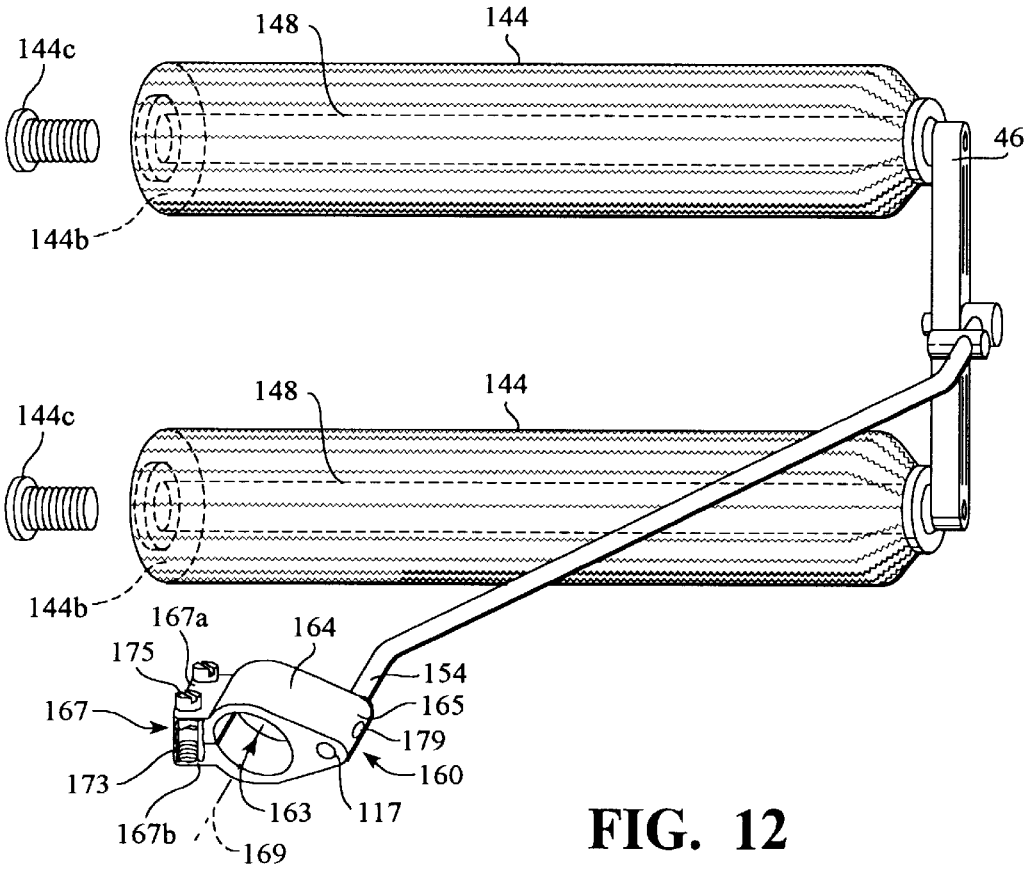
FIG. 12 is a perspective view of the apparatus shown in FIG. 3, in accord with an alternate embodiment.

Referring to FIGS. 8 and 12, an alternate embodiment of the clamp 160 is shown as including a body 164 having a cylindrical bore 163, a solid bulwark 165 and a bifurcated bulwark 167. The bore 163 extends along a longitudinal axis 169, with the solid bulwark 165 and the bifurcated bulwark 167 disposed on opposite sides of the bore 163's diameter. The bifurcated bulwark 167 includes a bore section 167*a* and a threaded section 167*b*. The bore section 167*a* includes at least one through hole 171. The threaded section 167*b* includes at least one threaded hole 173 which is axially aligned with the through hole 171. The diameter of the through hole 171 is larger than the diameter of the threaded hole 173 so that a screw 175 adapted to threadably engage the threaded hole 173, passes through the through hole 171. In this fashion, a head of the screw 175 presses the bore section 167*a* against the threaded section 167*b*, constricting the size of the bore 163 and securing the clamp 160 to the wand 117, shown more clearly in FIG. 13.

A button 144*b*, formed of any suitable lightweight material, is attached at opposing ends of each roller-brush 144. Typically, the button 144*b* is held in place by a screw 144*c* passed through the center thereof and threadably engaging the shaft 148. It is preferred that the buttons 144*b* and the cross-member 46 be made from nylon or some other polymer-based material. In this fashion, the mass of the roller-brush applicator 112 is reduced.

Figure 13:
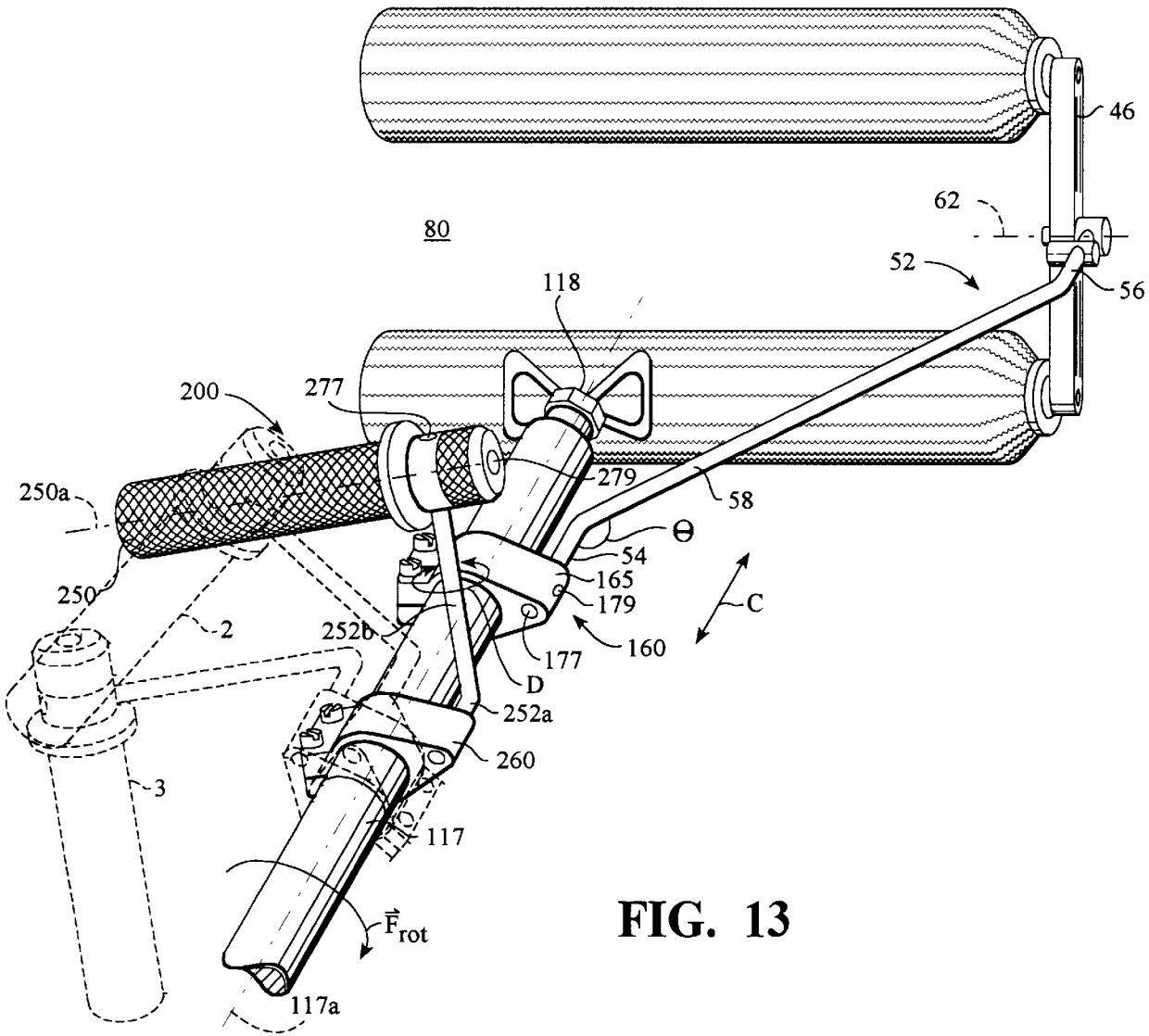
FIG. 13 is a perspective view of the apparatus, shown in FIG. 12, attached to the embodiment shown in FIG. 8 and including a forwardly mounted handle.

As shown in FIG. 13, the frame 52 is connected to the solid bulwark 165 in any conventional manner. In the disclosed embodiment, the solid bulwark 165 includes a recess 177 that extends parallel to the wand 117. The cross-section of the recess is complementary to the cross-section of the first portion 54, which is disposed therein. The first section 54 is retained within the recess 177 by a locking screw 179 extending through the solid bulwark 165, transverse to the recess 177. The frame 52 is orientated so that the first section 54 extends parallel to the centerline 117*a* of the wand 117, with the third portion 58 extending away therefrom at the oblique angle Θ. The locking screw 179 seats against the first portion 54, wedging the same against the interior of the recess 177. An advantage with the clamp 160 is that it may be attached any where along the length, shown in direction C, of the wand 117. This allows the distance between the nozzle 118 and the target plane 80 to be varied, which allows varying the size of the flow envelope, as discussed above. This is particularly useful when the width of the cross-member 46 may be varied, discussed more fully below with respect to FIG. 14.

Referring to FIGS. 8 and 13, to reduce fatigue when using the wand 117, a handle 200 may be disposed between the outlet 115 and the nozzle 118. The handle 200 includes a clamp 260, which is identical to clamp 160, excepting that the recess 377 has a first portion 252*a* of an L-shaped rod disposed therein. The second portion 252*b* of the L-shaped rod extends from the first portion 252*a*, transverse thereto and away from the wand 117. A grip portion 250, having a circular cross-section, extends along a longitudinal axis 250*a* from the second portion 252*b*. The grip portion 250 includes a cylindrical recess 277 in which the second portion 252*b* is fitted. A threaded bore 279 extends from the recess 277 and parallel to the longitudinal axis 250*a*, terminating in an opening. A locking screw (not shown) may be disposed with the threaded bore 279 seating against the second portion 252*b*, securely fastening the grip portion 250 thereto. An advantage provided by the handle 200 is that it may be attached any where along the length, shown as direction C, of the wand 117.

In addition, the handle 200 may be orientated, shown in dashed lines as positions 2 and 3, to allow a user to employ the most comfortable grip when grasping the same. As described above, the third portion 58 extends away from the centerline 117*a*, terminating in the second portion 56. The second portion 56 extends parallel to the centerline 117*a* and has the cross-member 46 attached thereto. This arrangement creates a force $F_{rot}$ that tends to urge rotation of the wand 117 about the centerline 117*a*. With the grip portion 250 extending transverse to the centerline 117*a*, and parallel to the pivot axis 62, the arm of the hand which grasps the grip portion 250 is positioned to move the nozzle laterally by bending at the elbow. This position allows a user to maximize the vertical distances reached by the brush applicator 112, but causes premature fatiguing of the arm due to having to overcome $F_{rot}$. To reduce the fatigue on a user's arm, the clamp 160 may be rotated, with respect to the centerline 117*a*, so that the grip portion 250 extends transverse to the pivot axis 62, shown in dashed lines as position 3. In this fashion, the arm of the hand grasping the grip portion 250 is orientated so that the elbow points downwardly, which is a more relaxed position and reduces premature fatigue. In addition, the grip portion may be rotated in direction, D, about second portion 252*b*. In this fashion, handle 200 provides three degrees of freedom of movement.

Finally, the diameter of either the wand 117, the handle 200 or both should be of a suitable size to allow a firm grasp of the same by the hand of a user. Although the diameter may be of any size, it is typically in the range of 0.75 to 1.20 inch. It was discovered, however, that a diameter measuring 1.10 inches was critical. The average size hand of a user exhibited less fatigue, for a given amount of time, when grasping the handle 200 or the wand 117 having a diameter approximating 1.10 inches.

A diameter of this size also allows forming a fluid-tight seal between the segments which form the wand 117 without necessitating the use of wrenches, pliers or other tools. Specifically, by allowing a user to firmly grasp each segment that forms the wand 117, the segments may be threaded together and hand-tightened. In this fashion, the length of the wand 117 may be quickly and easily adjusted.

Figure 14:
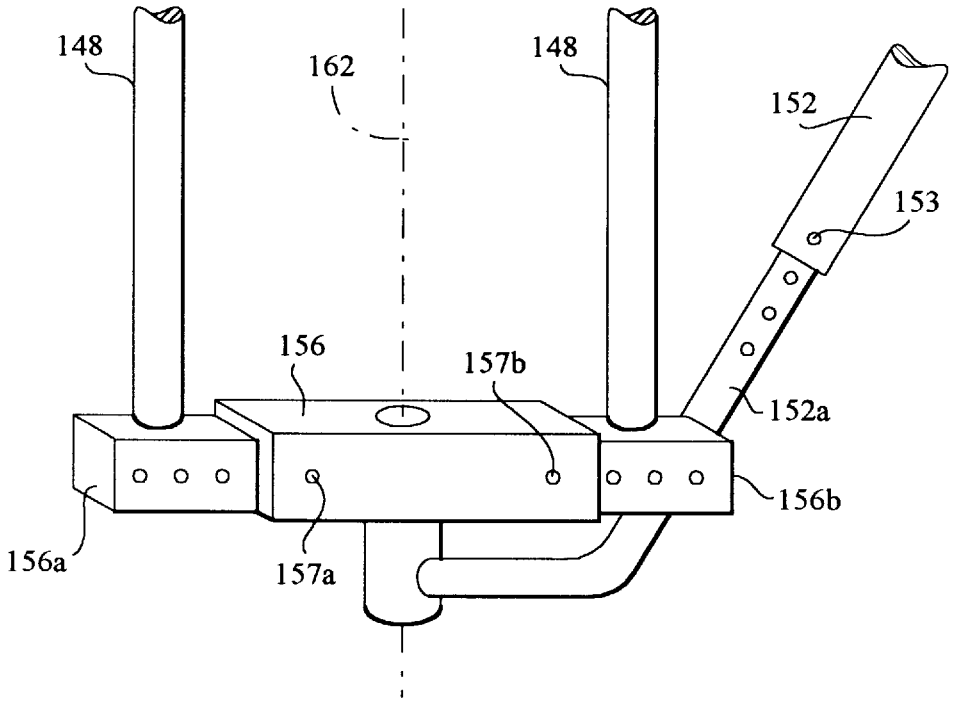
FIG. 14 is a perspective view of an alternate embodiment of the apparatus shown in FIG. 2.

Referring to FIG. 14, an alternative embodiment of frame and cross-member is shown. Although the spray-gun has been described with respect to using mini-roller-brushes, it should be understood that any size roller-brush may be employed. To that end, cross-member 156 includes two telescopic portions 156*a* and 156*b*, disposed on opposite sides of the pivot axis 162. Each of the telescopic portions 156*a* and 156*b* lock in place with pins 157*a* and 157*b*, respectively, allowing the shafts 148 to be displaced closer to, or further from, the pivot axis 162. Providing the spray-gun with an adjustable cross-member 156 allows employing roller-brush members 44 of differing sizes. This in turn allows differing nozzles to be employed to produce larger flow envelopes. The frame 152 may, therefore, include a telescopic portion 152*a* that locks in place with pin 153 to ensure that the minor axis of the ellipsis associated with the fluid envelope remains centered with respect to the nozzle.

I claim:

1. A fluid applicator comprising, a manifold body, including a fluid inlet and a fluid outlet and means for selectively placing said inlet and outlet in flow communication;

means, in fluid communication with said inlet, for remotely storing a fluid, with respect to said inlet, and transporting said fluid to said inlet under pressure;

a nozzle in fluid communication with said outlet, defining a flow path over which said fluid travels; and an elongated wand, extending along a longitudinal axis, between said nozzle and said outlet to remotely dispose said nozzle with respect to said manifold body, said wand including a plurality of coupled together segments and a rigid outer shielding having opposed termini and a flexible fluid passage disposed therebetween, whereby said flexible fluid passage is completely encased by said rigid outer shielding, and a pair of couplers, each of which is rigidly attached to said outer shielding at one of said opposed termini, with said flexible fluid passage disposed between, a portion of said pair of couplers being tapered such that the portion of the couplers are spaced-apart from said outer shielding.

2. The applicator as recited in claim 1 wherein said flexible fluid passage comprises of a high pressure fluid hose capable withstanding at least 3,500 psi.

3. A fluid applicator comprising, a manifold body, including a fluid inlet and a fluid outlet and means for selectively placing said inlet and outlet in flow communication;

means, in fluid communication with said inlet, for remotely storing a fluid, with respect to said inlet, and transporting said fluid to said inlet under pressure;

a nozzle in fluid communication with said outlet, defining a flow path over which said fluid travels; and an elongated wand, extending along a longitudinal axis, between said nozzle and said outlet to remotely dispose said nozzle with respect to said manifold body, said wand including a plurality of coupled together segments and a rigid outer shielding having opposed termini and a flexible fluid passage disposed therebetween, whereby said flexible fluid passage is completely encased by said rigid outer shielding, and an assembly removably attachable to said wand, said assembly having a frame with first and second opposed ends, a connecting means, attached to said first end, for attaching said frame proximate to said outlet, a pair of spaced-apart roller-brush members, defining a target plane therebetween, and a cross-member pivotally coupled to said second end, defining a pivot point, with each of said pair of spaced-apart roller-brush members rotatably attached to opposite ends of said cross-member.

4. The applicator as recited in claim 3 further including means, connected to said frame, for selectively adjusting a maximum rotational movement of said cross-member, whereby said roller-brush members are prevented from entering said flow path.

5. The applicator as recited in claim 4 wherein said cross-member traverses an arcuate path, with said adjusting means including a detent mounted to said frame, spaced-apart from said pivot point a distance, said detent being slidably engaged with said frame and extending into said arcuate path, with said maximum rotational movement being proportional to said distance.

6. The applicator as recited in claim 1 wherein said flexible fluid passage has opposed ends and a threaded attachment disposed at each of said opposed ends with each of said couplers having a threaded portion adapted to threadably engage one of said threaded attachments.

7. The applicator as recited in claim 1 wherein each of said couplers include first and second opposed sides, with said first side facing one of said opposed termini and terminating in a throughway extending from said first side to said second side, said second side having a cylindrical protrusion extending therefrom, with said flexible fluid passage fitting over said cylindrical protrusion forming a fluid-tight fit therewith.

8. A fluid applicator comprising, a manifold body, including a fluid inlet and a fluid outlet and means for selectively placing said inlet and outlet in flow communication;

means, in fluid communication with said inlet, for remotely storing a fluid, with respect to said inlet, and transporting said fluid to said inlet under pressure;

a nozzle; and an elongated wand, extending along a longitudinal axis, between said nozzle and said outlet to remotely dispose said nozzle with respect to said manifold body while placing said nozzle in fluid communication with said outlet, said wand including a plurality of coupled together segments, each of which includes a hollow, rigid, tubular body having opposed termini, a pair of couplers disposed at each of said opposed termini, and a flexible fluid passage fixedly attached to and extending between said pair of couplers.

9. The applicator as recited in claim 8 wherein each of said couplers is rigidly attached to said outer shielding at one of said opposed termini via an adhesive.

10. The applicator as recited in claim 8 wherein each of said couplers include first and second opposed sides, with said first side facing one of said opposed termini and terminating in a throughway which extends between said first and second opposed sides, said first side defining a threaded bore region and further including means for coupling adjacent segments together so as to place the flexible fluid passages associated therewith in fluid communication while forming a fluid-tight seal therebetween.

11. The applicator as recited in claim 10 wherein said coupling means includes a threaded barrel adapted to threadably engage threaded bore regions of adjacent segments.

12. The applicator as recited in claim 10 wherein said coupling means includes having a threaded cylindrical body extending from one end of each segment, with said threaded cylindrical body being adapted to threadably engage a threaded bore region of an adjacent segment.

13. The applicator as recited in claim 8 wherein a portion of an outer surface of each of said couplers has a frustoconical shape, defining a void between said tubular housing and said coupler, with adhesive being disposed so as to fill a portion of said void, thereby fixedly attaching said second side to said tubular body.

14. The applicator as recited in claim 13 further including an aperture formed in said tubular body proximate to each of said termini, thereby placing said void in fluid communication with an exterior of said tubular body.

15. A fluid applicator comprising, a manifold body, including a fluid inlet and a fluid outlet and means for selectively placing said inlet and outlet in flow communication;

a nozzle;

means, in fluid communication with said inlet, for remotely storing a fluid, with respect to said inlet, and transporting said fluid to said inlet under pressure;

an elongated wand, extending along a longitudinal axis, between said nozzle and said outlet to remotely dispose said nozzle with respect to said manifold body while placing said nozzle in fluid communication with said outlet, said wand including a plurality of coupled together segments, each of which includes a hollow, rigid, tubular body having opposed termini, a pair of couplers disposed at each of said opposed termini, and a flexible fluid passage fixedly attached to and extending between each said pair of couplers; and an assembly removably attachable to said wand including a frame having a first and second end, a connecting means, attached to said first end, for attaching said frame to said wand, a cross-member pivotally connected to said second end, defining a pivot point, and a pair of spaced-apart roller-brush members rotatably attached to opposite ends of said cross-member.

16. The applicator as recited in claim 15 further including means, connected to said frame, for selectively adjusting a maximum rotational movement of said cross-member, whereby said roller-brush members are prevented from entering said flow path.

17. The applicator as recited in claim 16 said plurality of segments each includes a pair of couplers, each of which is rigidly attached to said outer shielding at one of said opposed termini via an adhesive.

18. The applicator as recited in claim 17 wherein each of said couplers include first and second opposed sides, with said first side facing one of said opposed termini and terminating in a throughway which extends between said first and second opposed sides, said first side defining a threaded bore region and further including means for coupling adjacent segments together so as to form a fluid-tight seal between the flexible fluid passages associated therewith.

* * * * *